United States Patent [19]

Chavee

[11] 3,960,084

[45] June 1, 1976

[54] FUSE FOR RIFLE-GRENADE

[75] Inventor: Rene M. Chavee, Genk, Belgium

[73] Assignee: Fabrique Nationale Herstal S.A. en abrege FN, Liege, Belgium

[22] Filed: June 4, 1974

[21] Appl. No.: 476,194

[30] Foreign Application Priority Data

Aug. 8, 1973 Belgium ..... 803328

[52] U.S. Cl. ..... 102/65.2; 102/78

[51] Int. Cl.[2] ..... F42C 15/02

[58] Field of Search ..... 102/65.2, 78

[56] References Cited

UNITED STATES PATENTS

| | | | |
|---|---|---|---|
| 2,371,151 | 3/1945 | Church et al. | 102/65.2 |
| 3,388,666 | 6/1968 | Walther | 102/65.2 |
| 3,410,214 | 11/1968 | Irion | 102/28 |
| 3,439,615 | 4/1969 | Forman et al. | 102/65.2 |

FOREIGN PATENTS OR APPLICATIONS

| | | | |
|---|---|---|---|
| 10,219 | 4/1913 | United Kingdom | 102/65.2 |
| 8,708 | 6/1915 | United Kingdom | 102/65.2 |

*Primary Examiner*—Verlin R. Pendegrass
*Attorney, Agent, or Firm*—Bacon & Thomas

[57] ABSTRACT

The invention pertains to a fuse for rifle-grenades and similar, wherein means are provided to visually indicate whether the first element of the pyrotechnic claim of the fuse, for instance a detonator, is live or not.

3 Claims, 1 Drawing Figure

FUSE FOR RIFLE-GRENADE

Figure 1:
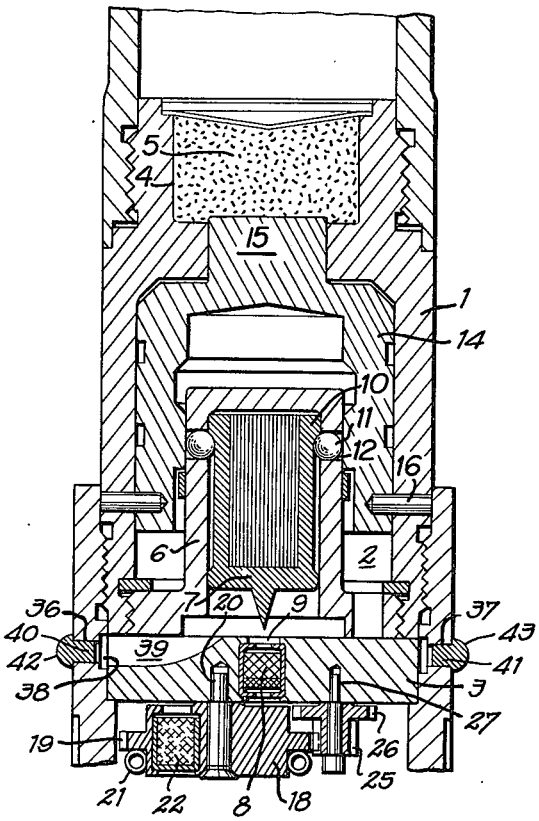

This invention concerns an improvement to a fuse for a rifle grenade including a body having an axial bore, said body being closed at one end by a holder for a detonator and terminating at its other end in a housing for a propellent charge, said detonator and said propellent charge forming part of a pyrotechnic chain; a sleeve mounted in said bore and housing an inertia firing pin; locking members for locking said firing pin in its inactive position; a control member for said locking members, said control member being constituted by a slidable bolt part of which surrounds said sleeve and one end of which terminates at said housing, said slidable bolt being able to be moved from an active position wherein it locks said locking members to an inactive position wherein it liberates said locking members; and shearable pins securing said bolt to said body.

In this fuse the detonator holder carries an anchor mechanism including a rotor holding a relay charge which also forms part of said pyrotechnic chain and which is normally out of alignment with the detonator due to the fact that it is locked in its inactive position. Upon combustion of the propellent charge by means of a cartridge shot by a rifle, the abovementioned pins are sheared due to which the bolt is displaced towards its inactive position by the gases produced by this combustion. Consequently also locking members are freed so that the inertia firing pin is liberated. Also the rotor of the anchor mechanism is liberated so that the rotor is stepwise displaced until the relay charge is in alignment with the detonator which is fired by the firing pin upon impact of the projectile.

It proved desirable to provide such a fuse with visual means of control making it possible to determine visually and at a certain distance, the grenade being on the ground after a failure, whether combustion of the detonator had taken place or not. In the affirmative, the grenade could then be handled without danger, whereas in the other case it could not.

According to the invention, this visual control is rendered possible by providing, in the body of the fuse, at least one passage communicating with the axial bore of that body, behind the said support disc, this passage normally being closed by a plug visible from outside the fuse, this plug being intended to be expelled on combustion of the detonator.

Preferably, two such passages, each with its plug, will be provided so as to furnish an indication, whatever may be the position occupied by the grenade on the ground, after a failure.

One way of implementing this invention is described below as a non-restrictive indication, reference being made to the attached FIGURE This FIGURE represents an axial section of a fuse according to the present invention.

This fuse comprises a body 1 with an axial bore 2. This body 1 is closed at one end by a disc 3 carrying a detonator 8 and terminates at its other end in a housing 4 containing a propellent charge 5 which together with the detonator 8 forms part of a pyrotechnic chain. A sleeve 6 mounted in the axial bore 2 houses an inertia firing pin 7 the point of which is coaxial with a passage 9 of the disc 3 wherein the detonator 8 is mounted. The firing pin 7 has a shoulder portion 10 and locking balls 11 normally make contact with the firing pin 7 below this shoulder 10. The balls 11 are housed in corresponding holes 12 of the sleeve 6 and are normally maintained in their active or locking position by a locking member or bolt 14 which has a cylindrical portion surrounding the sleeve 6 and an upper portion 15 terminating at the housing 4. This locking member 14 is normally secured to the body 1 by means of the shearable pins 16.

An anchor mechanism is mounted on the lower face of the disc 3. This mechanism includes a rotor 18 having teeth 19 and freely pivoted in 20 on disc 3. This rotor 18 is drawn back by a spring 21; it bears an eccentric relay charge 22 capable of being brought, at the end of travel of the rotor, into alignment with axial passage 9, i.e. with the pyrotechnic chain of the munition. The teeth 19 cooperate with an anchor wheel 26 pivoted in 27 on the disc 3.

The visual means of control according to this invention are in fact constituted by two diametrically opposed radial passages, 36 and 37 respectively, provided in the body 1 of the fuse. These passages communicate with the bore 2, behind the support disc 3, by the intermediary of an annular groove 38 in the said body and a milling 39 in the disc 3. Plugs 40 and 41 are engaged respectively in the said passages 36 and 37 in such a way that their heads, respectively 42 and 43, project slightly outside the fuse, so as to be quite visible.

It is clear that, in the event of a failure, these plugs will remain in place provided there has been no combustion of the detonator 8. In the contrary case, the pressure of the gases in the milling 39 and the circular groove 38 resulting from the combustion of the detonator 8 causes the ejection of the said plugs 40 and 41.

It is evident that various modifications can be made to the fuse described above without thereby going beyond the limits of this invention. For instance, the communication between the radial passage(s) and the central bore of the fuse body can be effected in any suitable manner, prorata to the morphology of the fuse to be equipped. The number and arrangement of the said passages are also variable from one case to another.

What I claim is:

1. A fuse for a rifle grenade including:

a body (1) having an axial bore (2), said body being closed at one end of a holder (3) for a detonator (8) and terminating at its other end in a housing for a propellent charge (5), said detonator and said propellent charge forming part of a pyrotechnic chain;

a sleeve (6) mounted in said bore (2) and housing;

locking members (11) for locking said firing pin in its inactive position;

a control member (15) for said locking members (11), said control member being constituted by a slidable bolt part of which surrounds said sleeve and one end of which terminates in said housing, said slidable bolt being movable from an active position wherein it locks said locking members to an inactive position wherein it liberates said locking members;

shearable pins (16) securing said bolt (15) to said body (1);

at least one passage (39) traversing said body and communicating with said axial bore;

and at least one plug (40, 41) mounted in the outer wall of the fuse and closing said passage, said plug being visible from the outside of the fuse and being expelled upon combustion of said detonator thus indicating this combustion.

2. A fuse as defined in claim 1 wherein said plug includes an enlarged head portion projecting outside said body.

3. A fuse as defined in claim 1 including at least two of said passages and plugs so positioned relative to said body that at least one of them is visible irrespective of the position of the rifle grenade on the ground.

* * * * *